United States Patent [19]

Janz

[11] Patent Number: 5,039,250

[45] Date of Patent: Aug. 13, 1991

[54] ENVIRONMENT CONTROL BARRIER AND APPARATUS AND METHOD FOR THE INSTALLATION OF THE BARRIER

[76] Inventor: Arnold Janz, Box 140, Site 1, R.R. #3, Fort Saskatchewan, Alberta, Canada, T8L 2N9

[21] Appl. No.: 302,988

[22] Filed: Jan. 30, 1989

[51] Int. Cl.[5] ..... F02B 3/12

[52] U.S. Cl. ..... 405/15; 256/12.5; 405/258; 405/16

[58] Field of Search ..... 405/21, 30, 31, 32, 405/15, 16, 258; 244/114; 256/12.5

[56] References Cited

U.S. PATENT DOCUMENTS

| | | | |
|---|---|---|---|
| 1,175,962 | 3/1916 | Latham | 405/31 |
| 3,037,726 | 6/1962 | Phillips | 256/12.5 X |
| 4,221,500 | 9/1980 | Garrett . | |
| 4,300,857 | 11/1981 | Santamaria . | |
| 4,339,114 | 7/1982 | Deike . | |
| 4,353,946 | 10/1982 | Bowers . | |
| 4,490,071 | 12/1984 | Morrisroe . | |
| 4,534,675 | 8/1984 | Morrisroe . | |
| 4,549,724 | 10/1985 | Taillandier . | |
| 4,784,520 | 11/1988 | Stevens | 405/21 |

FOREIGN PATENT DOCUMENTS

| | | | |
|---|---|---|---|
| 1168491 | 5/1984 | Canada . | |
| 0278881 | 8/1988 | European Pat. Off. | 256/12.5 |
| 973693 | 11/1982 | Switzerland . | |
| 1383011 | 2/1975 | United Kingdom . | |

OTHER PUBLICATIONS

David H. Young, "Snowfence Placement and Compatability with Land Use", Right of Way Journal, International Right of Way Association, Dec., 1987.

Brochure titled: "Beach Prisms", Beach Prisms Ltd. (date not known).

Research Disclosure 240028, Apr. 10, 1984, Owens-Corning Fibreglass.

Advertisments for: "Slitted Row Covers" obtained from: (1) Western Multicultural Specialists Ltd., 1988 Wholesale Growers Seed and Supply Catalogue, Calgary, Alberta, and Surrey, B.C., Canada; and (2) Sharp & Son Limited, Greenhouse Structures and Supplies Catalogue, Burnaby, B.C., date not known.

Research Disclosure 232011, Aug. 10, 1983, Owens-Corning Fibreglass.

State of California, Business and Transportation Agency, Department of Public Works Publication, "Bank and Shore Protection in California Highway Practice", Nov., 1970 at pp. 5, 6, 9, 95, 97, 165, 167, 177 and 194.

Brochure titled: "Ero-con Slit Fencing Machine", by C.W.O. Inc., undated, but obtained at trade show at Reno, Nevada, U.S.A., in Feb. 1987.

United States Department of the Interior, Office of Surface Mining, Washington, D.C., Handbook of Alternative Sediment Control Methodologies for Mines Lands, Mar. 1985, at pp. 60-73.

Canadian Petroleum Association, "Guidelines for the Reclamation of Mineral Disturbances", undated at pp. 10 to 25 (date not known), about 1987).

(List continued on next page.)

*Primary Examiner*—Dennis L. Taylor

*Attorney, Agent, or Firm*—Anthony R. Lambert

[57] ABSTRACT

A barrier to be installed on a ground surface includes a tranversely stiff folded longitudinal sheet folded downward about a longitudinal axis to form an apex. The longitudinal edges of the sheet are seated in furrows in the ground surface and secured by bolts to retain the barrier in place. The sheet has a chosen permeability selected according to its intended application. In one embodiment, the barrier may also be longitudinally stiff and include a raised lip for preventing water splashing over the barrier from eroding soil on the downstream side of the barrier. There is also described an apparatus for installing such a longitudinal sheet when the sheet is made of flexible material. The method of installing the barrier includes forming two furrows in the ground, shaping the longitudinal sheet so that it is folded about a longitudinal axis, placing longitudinal edges of the sheet in the furrows and closing the furrows.

3 Claims, 3 Drawing Sheets

OTHER PUBLICATIONS

Typical Filter Fence Installation Design, at pp. 151, 152, 155 and 185, Demonstration of Erosion and Sediment Control Technology, Lake Tahoe Region, U.S. Environmental Protection Agency, EPA-600/2-7-8-208, Dec. 1978.

Brochure titled: "Slit Stop Sediment Control Fencing", by American Excelsior Company, date not known.

Brochure titled: "Anti-Wash/Geojute", by Belton Industries, Inc. 1987.

Brochure titled: "Snow Strap" by Signode Industries Inc., undated, but obtained at trade show at Reno, Nev., U.S.A. in Feb. 1987.

Advertisement Brochure titled: "Kontrol Fence", by Nicolon, Inc. undated.

Hagen, et al., "Designing Narrow Strip Barrier Systems to Control Wind Erosion", in Journal of Soil and Water Conservation, Nov.-Dec., 1972.

Bailey et al., "Permanent Cost-Effective Erosion Control", at p. 271, undated.

Hackett, "Landscape Development of Steep Slopes", Oriel Press, 1972 at p. 40.

ENVIRONMENT CONTROL BARRIER AND APPARATUS AND METHOD FOR THE INSTALLATION OF THE BARRIER

FIELD OF INVENTION

The present invention relates to barrier systems, and in particular to a barrier for environmental control and a method and apparatus for installing the barrier.

BACKGROUND OF THE INVENTION

Barrier systems have a variety of uses in a wide range of industries. Their uses include: protection of soil from water or wind erosion, protection of crops and plants from wind, sand trapping for dune or beach development, dust control, snow fences, livestock fences, water diversion, berms for storage of water or other liquids, silt fences and canal systems for water transport or liquid waste transport.

The design of such barrier systems depends to a large extent on their application. For example, sediment control barriers include the use of straw bales secured end to end and to the ground perpendicularly across the flow of water, sand bags piled on top of each other and aligned end to end perpendicularly across the flow of water, various kinds of log and stone barriers, cross trenches, terraced slopes, various kinds of concrete structures and gabions. Such designs may be found in the "Guidelines for the Reclamation of Linear Disturbances", produced by the Environmental Planning and Management Committee of the Canadian Petroleum Association.

Sediment control barriers also include filter fences, constructed of filter fabric, posts and wire fences. These are single vertical barriers made from a fabric supported in an upright position by posts and support mesh. Another design is a brush filter barrier made from a filter fabric draped over a brush barrier. Such designs are discussed in the "Handbook of Alternative Sediment Control Methodologies for Mined Lands", March 1985, U.S. Department of the Interior, Office of Surface Mining, Washington, D.C.

Another kind of barrier used for erosion control includes a matting or blanket, for example a weaved matting, placed directly on the ground. Small grains or grasses grow up through the weave of the matting to form the barrier. Such a flexible fabric blanket is disclosed in U.S. Pat. No. 4,292,365. In an alternative form, the flexible fabric blanket is wrapped around itself and placed vertically upward in a ditch to form a 3-ply vertical barrier.

A further use of barriers is for snow fencing. The U.S. Pat. No. 4,339,114, discloses such a snow fence made of a framing structure for supporting a fence face between spaced upright members. A mesh is placed over the frame, and angled supports on the leeward side of the fence support the fence. The angled supports attach to the upright posts at intermediate points on the upright posts.

These barriers suffer from certain disadvantages. The snow fence described in U.S. Pat. No. 4,339,114, is complex and expensive to build. For use in roadside erosion control applications, hay bales suffer the disadvantage of quickly disintegrating, rock piles and other rigid barriers are dangerous to motor vehicles that leave the road, and vertical fences are difficult to maintain, in that they tend to collapse under the weight of sediment.

The present invention is directed to overcoming these disadvantages, while providing a fence that is easy to install and easy to maintain.

SUMMARY OF INVENTION

The present invention provides, in one embodiment, a barrier that is easy to install, traps sediment, without creating further erosion, and is collapsible under the impact of a road vehicle.

In one embodiment that invention provides a barrier assembly installed adjacent a roadway on which vehicles travel and across a slope on the ground comprising:

a longitudinal mesh sheet having a unitary structure and being folded about a longitudinal axis to form an apex, the longitudinal mesh sheet having an upslope side and a downslope side and being transversely stiff at least on either side of the apex, and having first and second longitudinal edges on the upslope side and the downslope side, at least the longitudinal edge on the upslope side being secured in the ground, and the longitudinal mesh sheet having a mesh size selected to discriminate against a chosen size of particle, whereby the mesh sheet is collapsible under the weight of impact of a vehicle that travels on the roadway; and a plurality of anchors for securing the longitudinal edges of the mesh sheet to the ground.

In another embodiment, the invention includes the mesh sheet having a longitudinally raised lip formed by the material of the mesh sheet adjacent one of the first and second longitudinal edges, and in the preferred embodiment the sheet forms an angle of between about 60 and 90 degrees about the apex and has an open side opposite the apex.

The sheet may be inherently transversely stiff or may be stiffened by transverse ribs extending outward from the longitudinal axis.

The invention also provides several embodiments of an apparatus for installing in the ground flexible elongate barrier material which is transversely stiff and which has a longitudinal axis; one of the apparatuses comprising: a frame moveable over the ground, barrier supply means for mounting a supply of the barrier material on the frame, barrier forming means mounted on the frame for receiving the barrier material from the barrier supply means, for folding the barrier material about its longitudinal axis and for positioning the barrier material on the ground, and means for securing the barrier material to the ground.

Further summary of embodiments of the invention may be found in the claims.

BRIEF DESCRIPTION OF THE DRAWINGS

In drawings which illustrate embodiments of the present invention by way of example, without intending to restrict the scope of the claims;

DESCRIPTION OF THE PREFERRED EMBODIMENTS OF THE INVENTION

FIGS. 1, 2, 3 and 6 illustrate embodiments of a barrier constructed according to the invention. The embodiments shown are primarily intended for erosion control applications, particularly as barriers for the prevention of excessive erosion in roadside drainage ditches and on earth construction grades. Each of the barriers is self-supporting.

Figure 1:
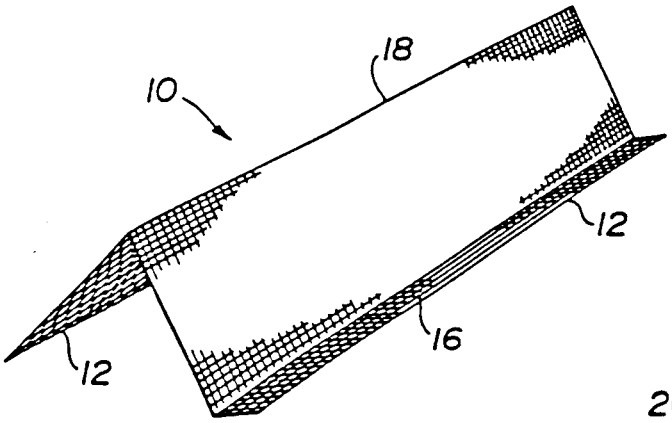
FIG. 1 is a perspective of a barrier according to the invention as may be used in roadside erosion control.
Figure 2:
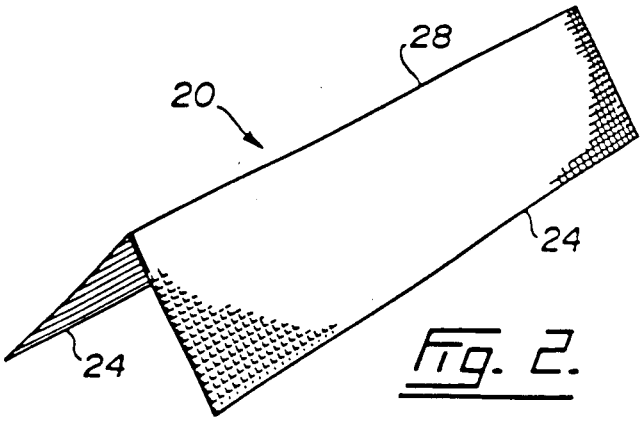
FIG. 2 is a perspective of a second embodiment of a barrier according to the invention as may be used in roadside erosion control.

In FIGS. 1 and 2, barriers 10 and 20 are made of stiff or rigid sheet materials. The transverse stiffness of the sheet material about the apices of the barriers should be chosen so that the barrier is self-supporting and capable of supporting the weight of run-off and sediment build up. For example, 22 gauge expanded metal mesh having smallest diameter openings of about 3/16" has been found to be sufficiently stiff.

For installation on the ground, the longitudinal edges 12 in FIG. 1, and longitudinal edges 24 in FIG. 2 are inserted into the ground, and may be secured by bolts (not shown). Barrier 10 includes lip 16 adjacent one of the longitudinal edges 12 and which rests on the ground surface. The lip 16 is also preferentially secured by anchors or bolts (not shown) to the ground. The barrier material is folded downward about the longitudinal axis 18 to form an apex. The material is transversely stiff on either side of the apex to give the barrier strength.

When water passes over the barrier 10, the water tends to erode the soil on the down slope side of the barrier, and thus create greater erosion. The lip 16 displaces the energy of the water, and reduces the amount of erosion. If desired, cloth material, not shown, may be placed on the ground under and downstream of the material so that splashes from the lip 16 do not erode the soil.

Figure 3:
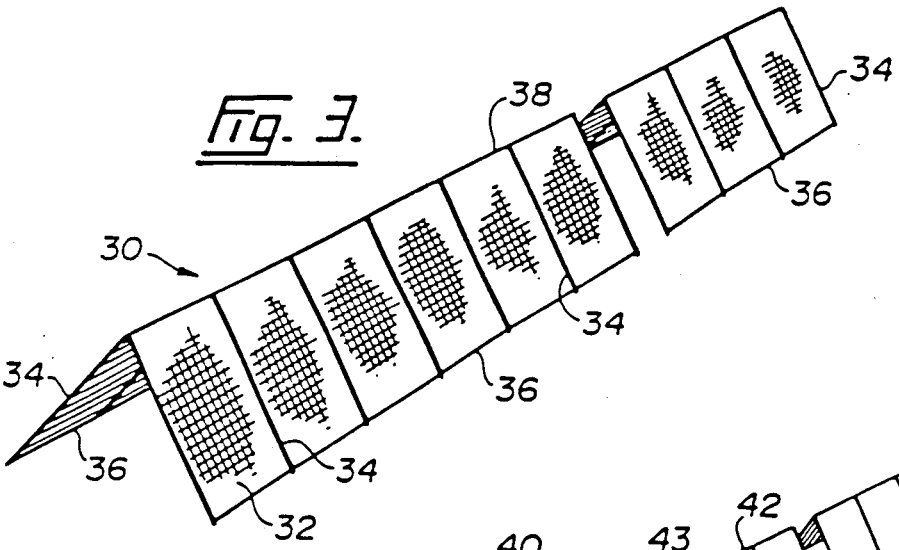
FIG. 3 is a perspective of a third embodiment of a barrier according to the invention.

FIG. 3 illustrates a barrier 30 that is constructed of flexible sheet material 32 reinforced with transverse ribs 34 distributed along the barrier 30. The barrier 30 is secured to the ground by insertion of the ribs 34 into the ground. The ribs 34 are separated along the longitudinal axis 38 at the apex to form two sets of ribs each extending outward from the longitudinal axis 38. The ribs 34 may be attached to the sheet material 32 by interweaving the ribs 34 with the sheet material 32.

The ribs 34 may be made of wood, metal or other suitable material, and are regularly distributed along the flexible sheet material 32 so that there is insufficient material between the ribs 34 on one side of the apex for the barrier 30 to be significantly distorted by rotation of the ribs 34 in relation to each other about an axis parallel to the longitudinal axis 38.

Figure 5:
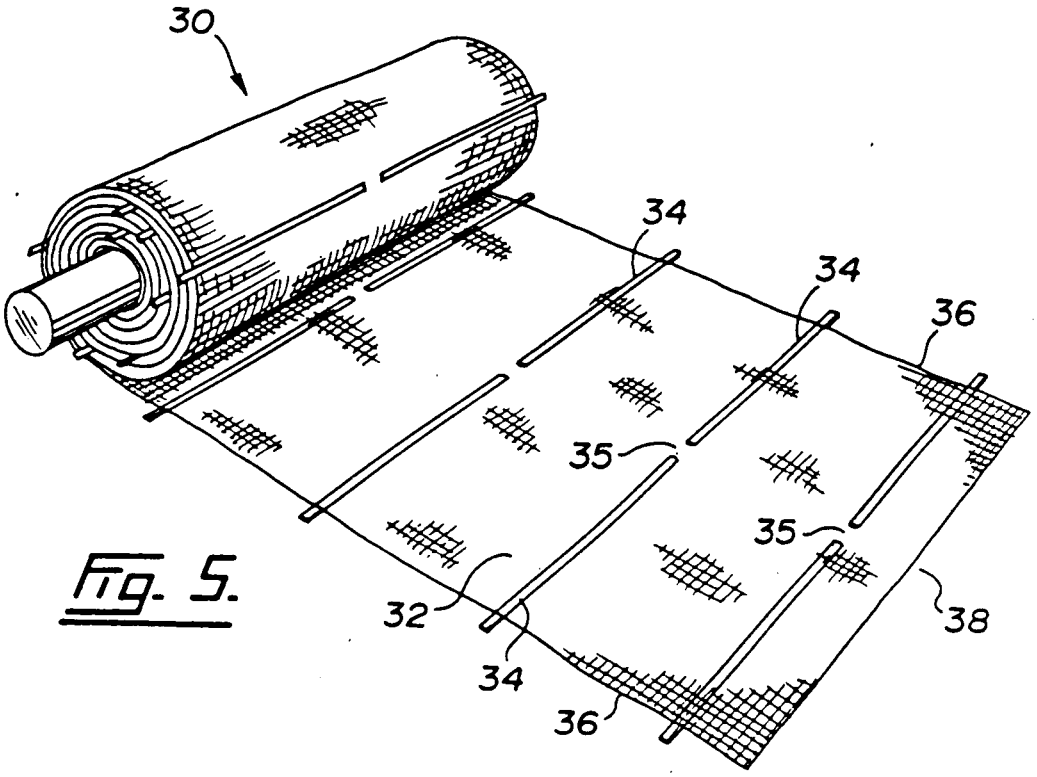
FIG. 5 is a perspective of barrier forming material as may be used to form the barrier of FIG. 3.

However, the sets of ribs 34 on either side of the longitudinal axis 38 are rotatable in relation to each other. This may be achieved, for example, preferably by separation of the two sets of ribs as shown in FIG. 5, at 36. Other methods of hinging the ribs on either side of the apex may be used, for example, as in the case of the snow fence shown in FIG. 6, using interlocking chain links at the upper ends of the ribs.

The flexible sheet material 32 of the barrier 30 may be a natural or synthetic fabric, wire, plastic or other material. Preferably the material would be capable of being stored in a roll as shown in FIG. 5 for use with the apparatus to be described below.

The permeability of the barriers 10, 20 and 30, sometimes referred to as the porosity, should also be chosen to suit the application. For roadside erosion control applications, a 3/16" mesh has been found suitable, although finer mesh may be desirable to catch finer particles. The mesh works not only by acting as a screen for the particles, but also by slowing the water down near the barrier, so that the water loses the energy required for transporting eroded material. This eroded material is then deposited upstream of the barrier.

The transverse and longitudinal stiffness of the material should be chosen for its intended application, and the expected manner of installation. The barriers 10, 20 and 30 are more stable when folded downward to form an apex at their respective longitudinal axes 18, 28 and 38 so that the two sides of the sheets form an angle of about 90 degrees about the apex. However, additional height may be obtained by utilizing acute apical angles of less than 90 degrees, and preferably between 60 degrees and 90 degrees. With reduced angles, greater height is obtained for the same amount of material and is therefore more economical, but may require additional ground anchors or bolts (not shown).

For erosion control, the material used should be sufficiently transversely stiff whether from the inherent stiffness of the material or from the ribs to support the barriers under the pressure of normal run-off and accumulated sediment. For roadside erosion control applications, the material should be chosen so that the barriers 10, 20 and 30 collapse under the force of impact that may be expected from a road vehicle hitting the barriers.

In large measure, the collapsibility of the barriers is obtained by utilizing the shape of barrier described here, but it should be apparent that, for example, rigid steel plates should not be used.

For particular applications, different lengths of barriers may be used. For a longer barrier made of shorter lengths of barrier sections, the sections may be placed end to end. Such a configuration eases transport of the barriers and enables the barrier to follow the contours of the ground on which it is placed.

The barriers 10, 20 and 30 are preferably secured to the ground by inserting the longitudinal edges 12, 24 and 36 respectively into the ground, with additional ground anchors (not shown) if desired. In the case of barrier 30, the apparatus described below may be used for this purpose. In addition, the ribs 34 of barrier 30 may extend beyond the longitudinal edges 36 of the barrier 30 for insertion into the ground to secure the barrier in position.

When used for a barrier for preventing erosion, for example in a drainage ditch of a highway, the barriers 10, 20 or 30 will be preferably placed on the ground with equal lengths of exposed barrier on both the upstream and downstream sides. As water containing sediment then flows down the ditch, the water passes through and/or over the mesh of the barrier, leaving the sediment behind. If a succession of barriers are used, as will typically be the case, finer mesh may be used for downstream barriers, to catch the finer silt and clay particles passed by the upstream barriers. In general, the steeper the slope, the closer the barriers 10, 20 or 30 are placed together.

It is also desirable to have a splash guard placed near the barrier to prevent excessive erosion as water splashes over the barrier, especially when the barrier has been silted up on the upstream side. Such a splash guard or lip may consist of cloth placed downstream on the surface of the soil, or it may be formed by extension of the flexible material 32 of the barrier 30 beyond the ribs 34.

Figure 6:
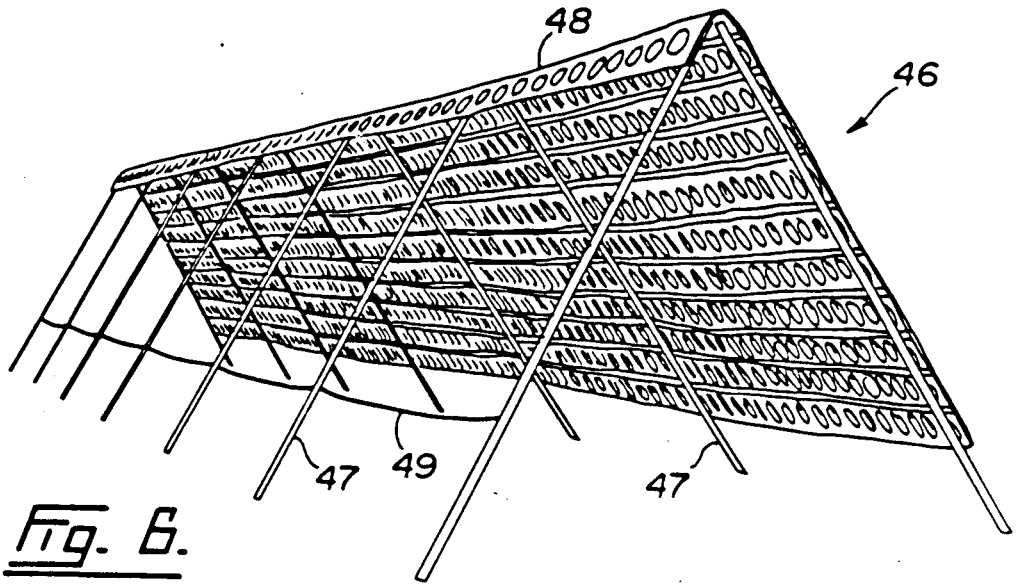
FIG. 6 is a perspective of a fifth embodiment of the invention as may be used as a snow fence.

The barriers 10, 20 or 30 may have various dimensions depending on the application. For example, larger barriers may be used when used as snow fences. When used as a snow fence, a barrier 46 similar to the barrier 30 should be used, with a light, permeable material (such as a thin plastic) used for the barrier material as illustrated in FIG. 6. Installation may be done by the apparatus discussed below. The transverse ribs 47 should preferably extend beyond the flexible material and there should preferably be sufficient exposed length of ribs 47 to allow the ribs 47 to be inserted in the ground.

As illustrated in FIG. 6, the flexible material need only be placed on one side of the barrier 46, with ribs 47 not covered by material on one side (except for a short strip of material near the top as shown at 48). The short strip of material that extends over the central longitudinal axis at 48 helps prevent sagging of the material while enabling the barrier 30 to have improved rigidity. Sufficient material should extend over the top to permit attachment of the material to the ribs.

To assist in strengthening the snow fence so that it can withstand repeated automatic machine installation, particularly on hard ground, some kind of reinforced coupling between the pairs of adjacent ribs 47 is desirable, such as interlocking chain links (not shown) attached to the ends of the ribs 47.

Rope, string or other thin long flexible material 49 may be used to constrain movement of the ribs 47 in relation to each other during installation.

For water diversion applications, the sheet material should be chosen to be impermeable. For market garden applications, for example as a tunnel for protecting plants from frost, plastic sheets may be used, reinforced with ribs.

Figure 4:
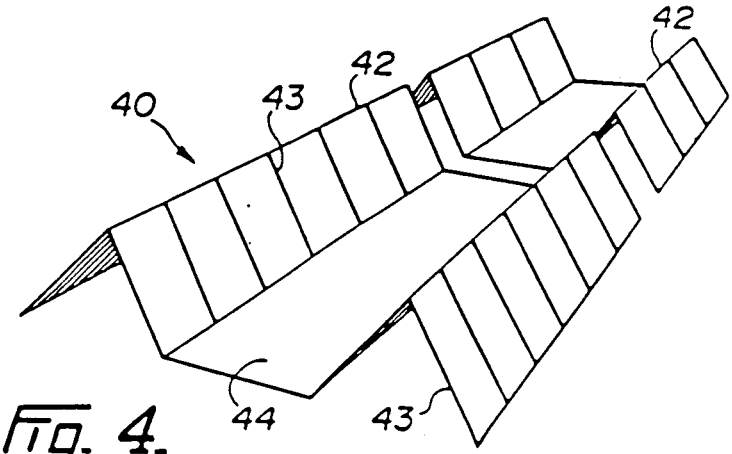
FIG. 4 is a perspective of a fourth embodiment of a barrier according to the invention.

FIG. 4 illustrates an alternative embodiment of a barrier 40 in which two parallel ridges 42 are formed along opposite longitudinal edges of the barrier material. The two ridges are joined by a panel 44. The barrier 40 shown here is made of flexible material stiffened with transverse ribs 43. The ribs 43 are separated or hinged at the fold lines of the longitudinal folds. Where a structure of this sort is made of an impervious material, it may be used as a self-supporting, above ground channel or ditch.

Installation of any of the barriers made with flexible sheet material may be achieved with the apparatus described below, utilizing the following method. The sheet material is stored on a roll on a frame, and the frame is moved over the ground. The plows attached to the frame make furrows in the ground. The sheet material is rolled off the roll, into a shaping device, which folds the sheet material downward. The ribs are then placed in the furrows, and the furrows are closed.

The sheet material is preferably sufficiently flexible to be stored on the roll, and the traverse ribs are preferably separated in the middle to allow folding of the sheet material.

Figure 7:
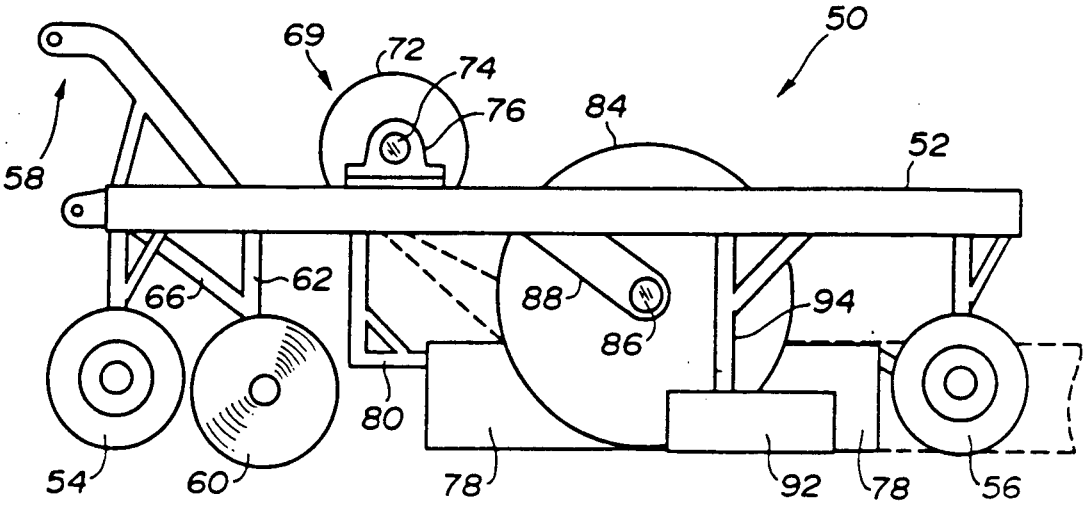
FIG. 7 is a side elevation view of an apparatus for installing the barrier of FIG. 3.
Figure 8:
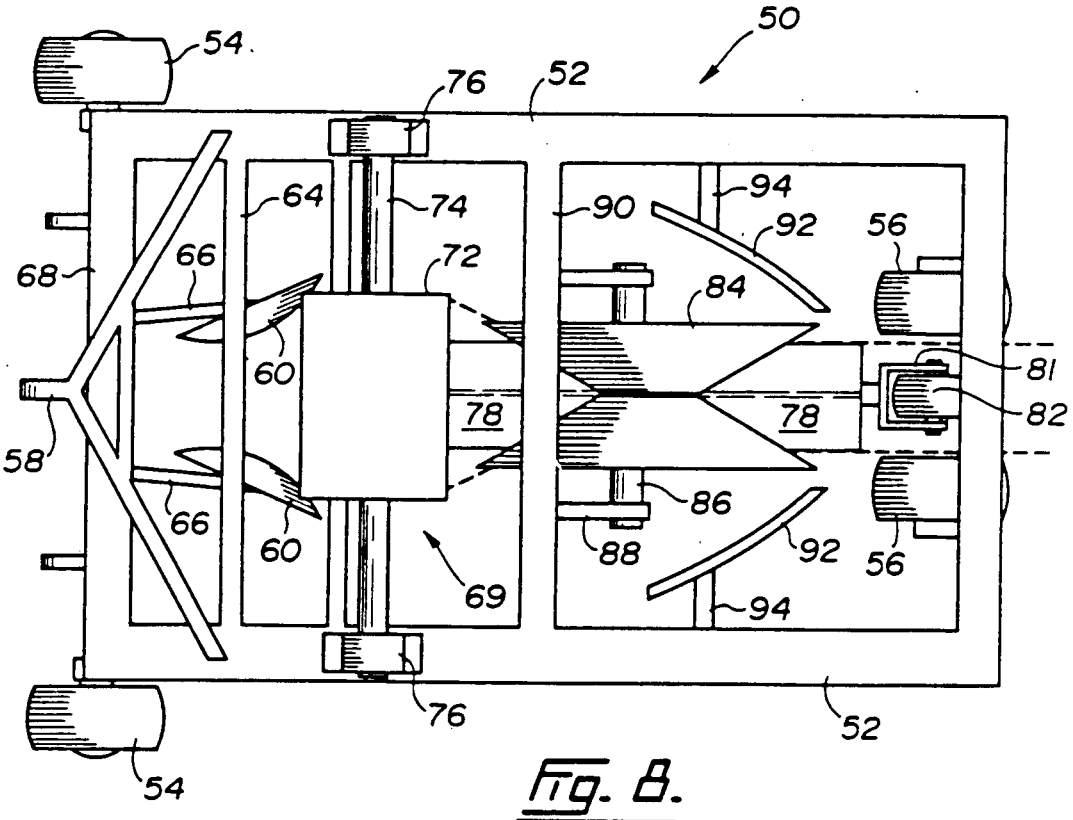
FIG. 8 is a plan view of the apparatus of FIG. 7.

Referring now to FIGS. 7 and 8, there is illustrated an apparatus 50 for installing a flexible barrier of the type shown in FIG. 3. The apparatus includes a rectangular frame 52 supported on two wheels 54 at the front and two wheels 56 at the back. The wheels 54 at the front are widely spaced, just outside the frame 52, while the two wheels 56 at the back are closer to one another so that they can serve as furrow packing wheels, as will be described in the following. At the front of the frame 52 is a three point hitch 58 that is used for drawing the apparatus 50 across a ground surface.

Two plows 60 are mounted on the frame 52 by height adjustable struts 62 projecting downwardly from the frame 52 at cross-member 64. The struts 62 are supported by braces 66 extending from the struts upwardly and forwardly to a hinged connection with a second frame end member 68. The two plows 60 diverge towards the rear of the frame, so that as the apparatus is drawn across a ground surface, the plows 60 open parallel furrows, lifting the ground in opposite directions. Hinging of the struts 62 permits adjustment of the height of the plows 60.

Immediately behind the plows 60 is a barrier material supply 69. This is a roll 72 of flexible barrier material mounted on a transverse shaft 74 in bearing 76.

Immediately below and extending to the rear of the barrier material supply 69 is a mold plate 78. This is an inverted V-shape plate mounted on a height adjustable arm 80 extending forwardly from the ridge of the mold plate 78 and upwardly to a connection with the frame cross-member 79. The mold plate 78 is arranged such that its longitudinal edges ride in the furrows produced by the plow discs 60. At the trailing edge of the mold plate 78 is a yoke 81 carrying a depth control wheel 82. Appropriate adjustment of the depth control wheel 82 in cooperation with the adjustable arm 80 permits the mold plate 78 to be positioned so that the longitudinal edges of the barrier forming material enter the furrows created by the plows 60.

Cooperating with the mold plate 78 to form the barrier from the material on roll 72 is a drum 84 with a double-cone shape matching the V-shape of the mold plate 78. The drum 84 is mounted on a transverse shaft 86 carried in turn by two arms 88 which are each hingedly connected to and projecting downwardly and to the rear from a frame cross-member 90. The weight of the drum 84 should be such that it has enough force to fold the barrier shaping material into the desired configuration. If the drum weight alone is insufficient, springs (not shown) could be used. For installation of a barrier having an apical angle of between 60° and 90°, the mold plate 78 should have sides angled at 60° to 90° to each other.

Barrier material from the roll 72 rolls off the bottom of the roll 72, over the mold plate 78 and under the drum 84. The engagement of the drum 84 with the mold plate 78 shapes the barrier material into an inverted V-shape and seats it with its longitudinal edges in the furrows opened by the two plows 60.

To the rear of the drum 84, on either side of the mold plate 78 are two furrow closing plates or plows 92. These are rearwardly converging plates mounted on the frame 52 by respective adjustable struts 94. They intercept the rows of material displaced by the plows 60 and displace it back into the furrows against the sides of the barrier which has been formed by the mold plate 78 and drum 84.

The two rear wheels 56 of the barrier forming apparatus 50 are located to receive the formed barrier between them and to press on the material displaced back into the furrows by the closing plates 92.

The apparatus may be modified for installation of a flexible barrier of the type shown in FIG. 4. In that case, the apparatus would include two widely spaced plows and two widely spaced, preferably adjustably spaced, drums and related mold plates.

While certain embodiments of the present invention have been described in the foregoing, it is to be understood that other embodiments are possible within the scope of the invention.

For installation of a barrier 30 having ribs 34 extending beyond the longitudinal edges 36 of the barrier 30, the apparatus may omit the plow discs and furrow closing implements, and the rib ends may be driven into the ground by the drum 84, providing it is heavy enough or sufficiently sprung, or by a second, heavy drum or roller mounted on the frame behind the drum 84.

Modifications that are substantially the same as the present invention may occur to a person skilled in the art, and these are intended to be included within the scope of the claims that follow.

I claim:

1. A barrier assembly installed adjacent a roadway on which vehicles travel and across a slope on the ground comprising:

a longitudinal mesh sheet having a unitary structure and being folded about a longitudinal axis to form an apex, the longitudinal mesh sheet having an upslope side and a downslope side and being transversely stiff at least on either side of the apex, and having first and second longitudinal edges on the upslope side and the downslope side, at least the longitudinal edge on the upslope side being secured in the ground, and the longitudinal mesh sheet having a mesh size selected to discriminate against a chosen size of particle, whereby the mesh sheet is collapsible under the weight of impact of a vehicle that travels on the roadway; and a plurality of anchors for securing the longitudinal edges of the mesh sheet to the ground.

2. The barrier of claim 1 in which the sheet forms an angle of between about 60 and 90 degrees about the apex and has an open side opposite the apex.

3. The barrier assembly of claim 1 in which the mesh sheet has a longitudinally raised lip formed by the material of the mesh sheet adjacent one of the first and second longitudinal edges.

* * * * *